US008985128B2

(12) United States Patent
Pyo et al.

(10) Patent No.: US 8,985,128 B2
(45) Date of Patent: Mar. 24, 2015

(54) DISH WASHER

(75) Inventors: Joon Ho Pyo, Seoul (KR); Byeong Hyeon Ju, Seoul (KR); Yong Jin Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 733 days.

(21) Appl. No.: 13/254,364

(22) PCT Filed: Jan. 6, 2010

(86) PCT No.: PCT/KR2010/000045

§ 371 (c)(1),
(2), (4) Date: Sep. 1, 2011

(87) PCT Pub. No.: WO2010/114217

PCT Pub. Date: Oct. 7, 2010

(65) Prior Publication Data

US 2011/0315174 A1 Dec. 29, 2011

(30) Foreign Application Priority Data

Apr. 3, 2009 (KR) ..... 10-2009-0028930

(51) Int. Cl.
*B08B 3/00* (2006.01)
*A47L 15/42* (2006.01)

(52) U.S. Cl.
CPC ..... *A47L 15/4246* (2013.01); *A47L 15/4225* (2013.01)
USPC ..... 134/186; 134/56 D; 134/57 D; 134/58 D; 134/184; 15/3

(58) Field of Classification Search
None
See application file for complete search history.

(56) References Cited

U.S. PATENT DOCUMENTS

| | | | | |
|---|---|---|---|---|
| 5,010,920 | A | 4/1991 | Tolf et al. | |
| 2006/0219272 | A1 * | 10/2006 | Lee et al. | 134/56 D |
| 2008/0309210 | A1 * | 12/2008 | Luisi et al. | 312/406.2 |

FOREIGN PATENT DOCUMENTS

| | | | |
|---|---|---|---|
| DE | 39 14760 | A1 | 11/1990 |
| DE | 690 02 668 | T2 | 2/1994 |
| DE | 92 15 365.8 | U1 | 4/1994 |
| DE | 690 15 219 | T2 | 5/1995 |
| DE | 295 11 295 | U1 | 9/1995 |
| DE | 10 2005 043 029 | A1 | 3/2007 |
| EP | 0 381 586 | A1 | 8/1990 |
| EP | 0 391 869 | A1 | 10/1990 |
| GB | 2 290 948 | A | 1/1996 |

* cited by examiner

*Primary Examiner* — Eric Golightly
(74) *Attorney, Agent, or Firm* — Birch, Stewart, Kolasch & Birch, LLP

(57) ABSTRACT

The present invention relates to a dish washer in which a structure for mounting a drain pump is improved for minimizing residual water, vibration and noise. The dish washer includes a cabinet which forms an exterior of the dish washer, a tub in the cabinet to form a space for washing the dishes, a sump assembly at a lower portion of the cabinet, the sump assembly having a drain chamber for holding washing water to be drained, and a drain pump assembly coupled to a lower side of an outside of the sump assembly so as to be in communication with one side of the drain chamber for draining the washing water from the drain chamber by pumping, wherein the drain pump assembly is mounted tilted upward at a predetermined angle from an inside bottom surface of the cabinet.

4 Claims, 3 Drawing Sheets

DISH WASHER

BACKGROUND OF THE INVENTION

1. Field of the Invention

The present invention relates to dish washers, and more particularly, to a dish washer in which a structure for mounting a drain pump is improved for minimizing residual water, vibration and noise.

2. Description of Related Art

The dish washer is a domestic appliance for washing and drying dishes by spraying water to the dishes, automatically. The dish washer is provided with a cabinet having a washing chamber formed therein, a plurality of racks in the washing chamber for holding the dishes, a sump for holding the washing water, a pump for supplying the washing water from the sump to spray arms, a sump assembly having a heater for heating the washing water and so on, and a plurality of spray arms arranged on upper/lower sides of the racks for spraying the washing water toward the dishes in the racks.

Upon putting the pump into operation, the spray arms spray the washing water pumped up by the pump toward the dishes for washing the dishes. The washing water sprayed thus is recovered by the sump and sprayed again toward the dishes. Upon finishing the washing, a drain pump comes into operation for draining the water from the sump to an outside of the dish washer through a hose, and, after drain pump is turned off, fresh water is supplied to the sump for rinsing. The fresh water is sprayed toward the dishes again, for rinsing the dishes.

However, the related art dish washer has inconvenience in that mounting/dismounting of the drain pump to/from the dish washer for replacement of components thereof is possible only after the dish washer itself is turned upside down to expose the sump assembly.

Moreover, the direct coupling of the drain pump to the sump assembly without vibration damping means results in direct transmission of vibration and consequential noise from the drain pump to the sump assembly, to affect vibration and noise of the dish washer itself.

To solve the problems, an object of the present invention is to provide a dish washer in which a mounting structure of the drain pump is improved for minimizing residual water, vibration and noise.

To achieve these objects and other advantages and in accordance with the purpose of the invention, as embodied and broadly described herein, a dish washer includes a cabinet which forms an exterior of the dish washer, a tub in the cabinet to form a space for washing the dishes, a sump assembly at a lower portion of the cabinet, the sump assembly having a drain chamber for holding washing water to be drained, and a drain pump assembly coupled to a lower side of an outside of the sump assembly so as to be in communication with one side of the drain chamber for draining the washing water from the drain chamber by pumping, wherein the drain pump assembly is mounted tilted upward at a predetermined angle from an inside bottom surface of the cabinet, and the drain pump assembly and the sump assembly are connected with an insulating material to each other.

The drain chamber is formed to have a depth that forms a minimum space L between an outside bottom surface of the drain chamber and the inside bottom surface of the cabinet.

The drain chamber further includes a chamber outlet in one side of a lower side of the drain chamber connected to the drain pump assembly.

The drain pump assembly further includes a chamber connection pipe connected to the chamber outlet.

The chamber connection pipe is mounted tilted upward by a predetermined angle from a center line of the chamber outlet for supporting the drain pump assembly.

The minimum space L is a space enough to prevent the drain pump assembly from interfering with the inside bottom surface of the cabinet in a state the drain pump assembly is coupled to the chamber outlet.

The dish washer further includes a check valve member placed in the chamber outlet for preventing residual water from flowing in a reverse direction from the drain pump assembly.

In another aspect of the present invention, a dish washer includes a cabinet which forms an exterior of the dish washer, a tub in the cabinet to form a space for washing the dishes, a sump assembly at a lower portion of the cabinet, the sump assembly having a drain chamber with a drain filter for filtering the washing water, and a drain pump assembly coupled to a lower side of an outside of the sump assembly so as to be in communication with one side of the drain chamber for draining the washing water from the drain chamber by pumping, wherein the drain pump assembly and the sump assembly are connected with an insulating material to each other, and a check valve member is placed in a connection flow passage.

The drain chamber is formed to have a depth that forms a minimum space L between an outside bottom surface of the drain chamber and the inside bottom surface of the cabinet.

The drain chamber further includes a chamber outlet in one side of a lower side of the drain chamber connected to the drain pump assembly, and the drain pump assembly further includes a chamber connection pipe connected to the chamber outlet.

The minimum space L is a space enough to prevent the drain pump assembly from interfering with the inside bottom surface of the cabinet in a state the drain pump assembly is coupled to the chamber outlet.

As has been described, the dish washer of the present invention has an advantage in which residual water can be minimized by tilted mounting of the drain pump.

The vibration insulating material used for the drain pump permits to minimize vibration and noise at the time the drain pump is in operation.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

DETAILED DESCRIPTION

Reference will now be made in detail to the specific embodiments of the present invention, examples of which are illustrated in the accompanying drawings. Wherever possible, the same reference numbers will be used throughout the drawings to refer to the same or like parts.

Figure 1:
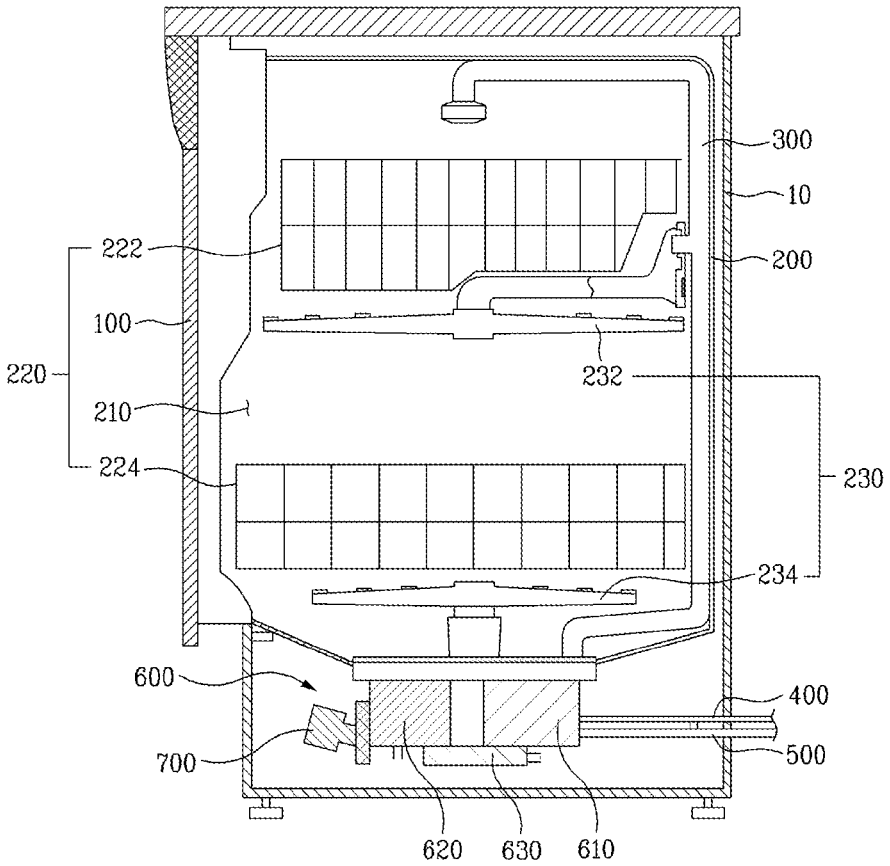
FIG. 1 illustrates a section of a dish washer in accordance with a preferred embodiment of the present invention.
Figure 2:
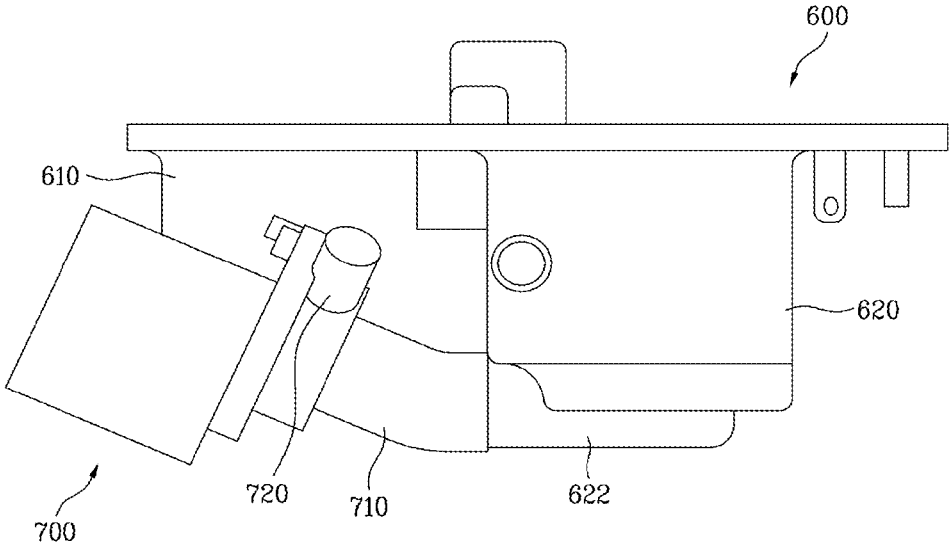
FIG. 2 illustrates the sump assembly in FIG. 1, schematically.
Figure 3:
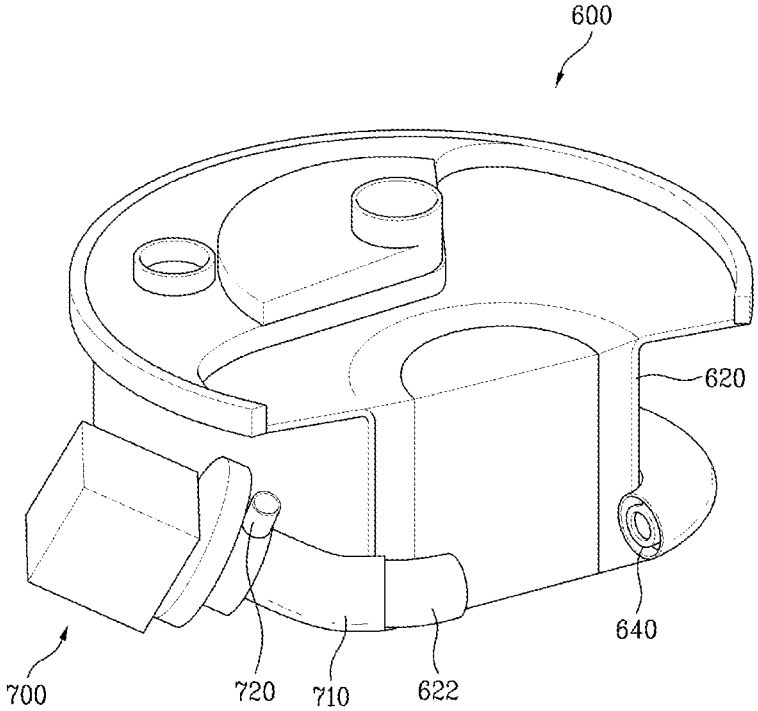
FIG. 3 illustrates a perspective view of the sump assembly in FIG. 1, partially.
Figure 4:
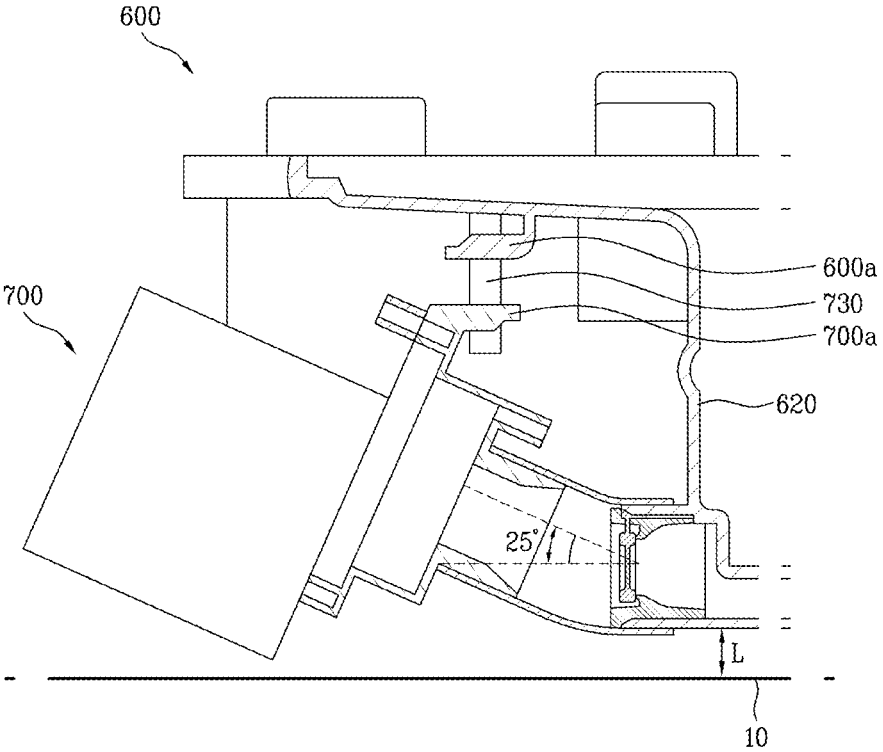
FIG. 4 illustrates a section of the sump assembly in FIG. 1, partially.
Figure 5:
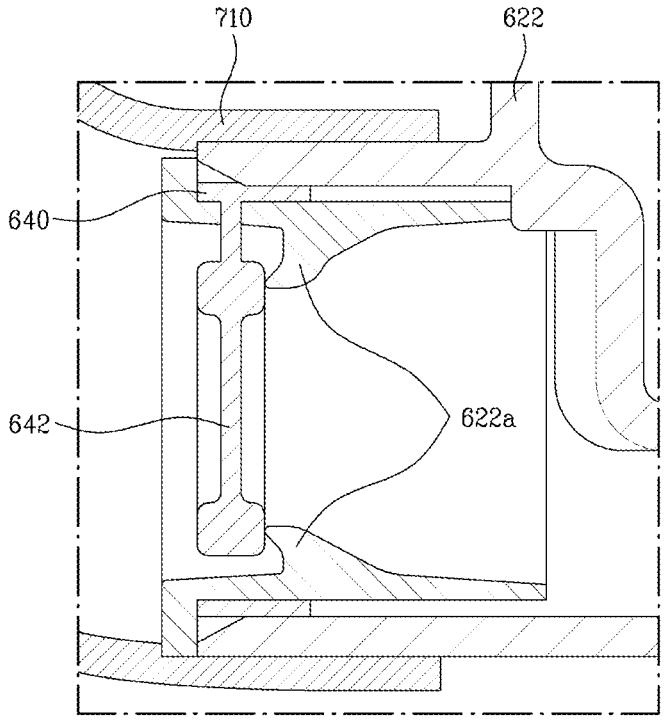
FIG. 5 illustrates a section showing a fastening state of a check valve member to the sump assembly in FIG. 1.
Figure 6:
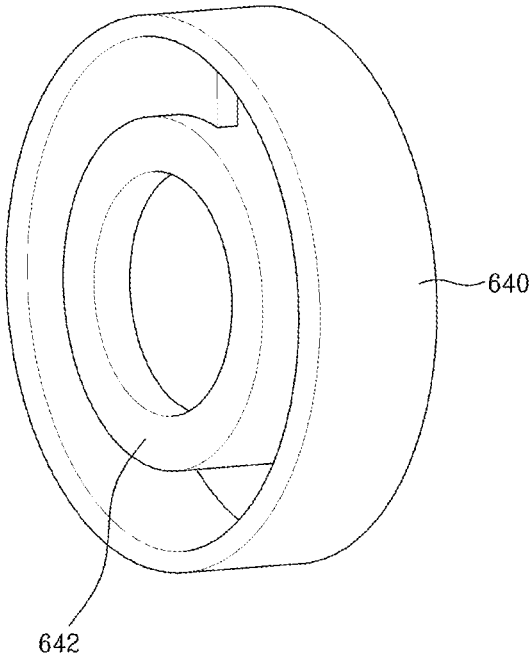
FIG. 6 illustrates a perspective view of the check valve member in FIG. 5.

FIG. 1 illustrates a section of a dish washer in accordance with a preferred embodiment of the present invention, FIG. 2 illustrates the sump assembly in FIG. 1 schematically, and FIG. 3 illustrates a perspective view of the sump assembly in FIG. 1 partially. FIG. 4 illustrates a section of the sump assembly in FIG. 1 partially, FIG. 5 illustrates a section showing a fastening state of a check valve member to the sump assembly in FIG. 1, and FIG. 6 illustrates a perspective view of the check valve member in FIG. 5.

Referring to FIG. 1, the dish washer includes a cabinet 10 which forms an exterior of the dish washer, a tub 200 which forms a washing chamber 210 for washing dishes, a door 100 for opening/closing the tub 200, and a sump assembly 600 for supplying/recovering the washing water.

The tub 200 has the washing chamber 210 formed therein for holding the dishes, and a plurality of racks 220 are mounted in the washing chamber 210 for placing the dishes thereon. The washing water is sprayed through the spray arms 230 in a state the dishes are placed on the racks 220 for washing the dishes.

The spray arm 230 includes an upper arm 232 under an upper rack 222, and a lower arm 234 under the lower rack 224. Both the upper arm and the lower arm are rotatably mounted, and each of the spray arms 230 has a plurality of nozzles (not shown) for spraying washing water to the dishes.

Referring to FIGS. 1 to 3, the sump assembly 600 is connected to the upper arm 232 and the lower arm 234 with a connection pipe 300. The sump assembly 600 receives the washing water from an external water supply source, stores the washing water in the sump 610, and supplies the washing water to the upper arm 232 and the lower arm 234 selectively or simultaneously through the connection pipe 300. The washing water used for washing is drained through a drain pipe 500.

Referring to FIGS. 2 and 3, the sump assembly 600 includes a sump 610 for holding the washing water, a water supply pump (not shown) for pumping up water from the sump 610, a drain chamber 620 for holding the washing water used in washing of the dishes, and a drain pump assembly 700 for draining the washing water. A heater (not shown) is mounted to the sump 610 for heating the washing water, and a drain filter (not shown) is mounted to the drain chamber 620 for filtering the washing water.

Different from the related art dish washer in which a drain pump assembly is formed on an inside of the sump assembly as one unit therewith, the sump assembly 600 of the present invention has the drain pump assembly 700 fastened to a lower side of an outside of the sump assembly 600, enabling to enlarge a space for placing a drain filter therein, which permits to place a larger drain filter therein to prevent the drain filter from clogging with foreign matter, thereby preventing draining efficiency from becoming poor.

The sump 610 has a cylindrical shape formed on one side of the sump assembly 600, with a heater (not shown) detachably mounted therein for heating the washing water held therein. The washing water heated by the heater is transferred to the tub 200 along a supply flow passage connected to the sump 210 and supplied through the spray arm 230.

The drain chamber 620 has a cylindrical shape formed on the other side of the sump assembly 600, with the drain filter mounted therein for filtering foreign matters from the washing water used in washing the dishes. The drain chamber 620 has an outside bottom surface spaced from an inside bottom surface of the cabinet 10 by a minimum distance L so that the outside bottom surface of the drain chamber 620 is not in contact with the inside bottom surface of the cabinet 10.

That is, the drain chamber 620 has a height which enables to provide the minimum distance L to the inside bottom surface of the cabinet 10 while securing the space for mounting the drain filter therein to the maximum (a reason of this will be described in description of a drain pump assembly). The washing water filtered at the drain filter is re-supplied through a water supply connection pipe 640 for washing the dishes until the drain pump comes into operation when the washing water is drained through the drain pipe 500.

The drain chamber 620 has a chamber outlet 622 in one side of a lower side in communication with the drain pump assembly 700. The chamber outlet 622 of a cylindrical tube shape has a check valve member 640 mounted to an inside end for preventing the washing water from flowing in a reverse direction from the drain pump assembly 700, which will be described, later. Moreover, the drain pump assembly 700 is mounted to the chamber outlet 622.

The drain pump assembly 700 includes a drain pump (not shown) and an impeller for pumping the washing water, and a drain motor for driving the drain pump. A chamber connection pipe 710 is connected to an impeller side of the drain pump assembly 700 for connection to the chamber outlet 622 in the drain chamber 620.

The chamber connection pipe 710 is tilted upward with reference to the inside bottom surface of the cabinet 10 so that the drain pump assembly 700 is mounted tilted with reference to the inside bottom surface of the cabinet 10. That is, the chamber connection pipe 710 is mounted tilted upward with reference to a length direction imaginary center line of the chamber outlet 622.

FIG. 4 illustrates an example of the chamber connection pipe 710 mounted tilted upward by 25 degrees with reference to the center line of the chamber outlet 622. If the chamber connection pipe 710 is formed parallel to the inside bottom surface of the cabinet 10, it is difficult to secure a drain chamber 620 of an adequate size if it is intended that the drain pump assembly 700 is mounted not to be in contact with the inside bottom surface of the cabinet 10 due to a size of the drain pump assembly 700.

This is because, if it is intended that the drain pump assembly 700 is mounted not to be in contact with the inside bottom surface of the cabinet 10, it is required that the chamber connection pipe 710 connected to the lower side of the drain chamber 620 is mounted with an adequate distance from the inside bottom surface of the cabinet 10. In order to achieve this, the drain chamber 620 is required to have an adequate distance from the inside bottom surface of the cabinet 10, that results in a lower height of the drain chamber 620.

However, in order to secure adequate efficiency of the drain filter in the drain chamber 620, the drain filter is required to have a certain size, leading to require an adequate sized drain chamber 620.

Accordingly, in order to secure the adequate sized drain chamber 620, it is preferable that the chamber connection pipe 710 is tilted upward with reference to the inside bottom surface of the cabinet 10, rather than formed parallel to the inside bottom surface of the cabinet 10.

Moreover, the upward tilting of the chamber connection pipe 710 is desirable in view of easy escape of air from an inside of the chamber connection pipe 710 when the drain pump assembly 700 is coupled thereto as well as easy mounting/dismounting of the chamber connection pipe 710.

The upward tilting of the chamber connection pipe 710 and formation of a discharge end 720 through which the washing water is drained by the drain pump at a side or an upper side of the drain pump assembly 700 is liable to lock air in the drain pump assembly 700. Since draining efficiency becomes poor if air formed during draining of the washing water is locked in the drain pump assembly 700, in order to prevent this from taking place, it is preferable that the discharge end 720 is formed, not at the upper side, but tilted in a side direction, slightly.

If the chamber connection pipe 710 is mounted tilted thus, the washing water is liable to flow in a reverse direction from the drain pump assembly 700 to the chamber connection pipe 710. In order to prevent the washing water from flowing in the reverse direction at a side of the drain pump, it is preferable that the check valve member 640 is placed in the chamber outlet 622.

Referring to FIGS. 5 and 6, the check valve member 640 is cylindrical, and has an outside circumference coupled to an inside of the chamber outlet 622, and an opening/closing portion 642 in contact with an annular projection 622*a* formed on an inside of the chamber outlet 622.

The check valve member 640 is mounted such that, when the washing water flows toward the check valve member 640 from the drain chamber 620, the opening/closing portion 642 is moved to the drain pump assembly 700 by a water pressure to open the chamber outlet 622, and when the washing water flows toward the check valve member 640 from the drain filter, the opening/closing portion 642 closes the chamber outlet 622.

If the check valve member 640 is placed in the chamber outlet 622 to position the check valve member 640 lower than a case when the check valve member 640 is formed in the chamber connection pipe 710, an amount of residual water can be minimized.

In the meantime, referring to FIG. 4, it is preferable that the drain pump assembly 700 is spaced a predetermined distance from the inside bottom surface of the cabinet 10 for preventing vibration generated at the time of operation of the drain pump assembly 700 from transmission. Therefore, it is preferable that the drain chamber 620 has a space L from the inside bottom surface of the cabinet 10 enough to secure an adequate size of the drain chamber 620 while the drain pump assembly 700 does not interfere with the inside bottom surface of the cabinet 10.

It is also preferable that the drain pump assembly 700 is insulated of vibration so that the vibration generated at the time of operation of the drain pump assembly 700 is prevented from transmitting to a washing space or an outside of the cabinet 10 through the sump assembly 600.

For this, referring to FIG. 4, the drain pump assembly 700 is coupled to an underside of the sump assembly 600 with a securing member 730.

The securing member 730, formed of an insulating material, such as rubber or silicone, connects one side of the drain pump assembly 700 to one side of the sump assembly 600. To do this, the drain pump assembly 700 and the sump assembly 600 have a first fastening portion 700*a* and a second fastening portion 600*a* formed thereon, respectively.

The securing member 730 has one end fastened to the first fastening portion 700*a* and the other end fastened to the second fastening portion 600*a* to connect the drain pump assembly 700 to the sump assembly 600. Since the securing member 730 is formed of insulating material, such as rubber or silicone, with predetermined elasticity, the transmission of the vibration generated at the time of operation of the drain pump assembly 700 can be insulated. Accordingly, the transmission of the operational vibration from the drain pump assembly 700 to the sump assembly 600 can be prevented.

Eventually, the dish washer of the present invention permits to secure easy mounting of the drain pump assembly and a size of the drain chamber that maximize the filter efficiency by mounting the drain pump assembly tilted with respect to the inside bottom surface of the cabinet.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A dish washer comprising:

a cabinet which forms an exterior of the dish washer;

a tub in the cabinet to form a space for washing dishes;

a sump assembly at a lower portion of the cabinet, the sump assembly having a drain chamber for holding washing water to be drained, the drain chamber including a chamber outlet in one side of a lower side of the drain chamber; and a drain pump assembly coupled to a lower side of an outside of the sump assembly so as to be in communication with one side of the drain chamber for draining the washing water from the drain chamber by pumping, the drain pump assembly including a chamber connection pipe connected to the chamber outlet, wherein the chamber connection pipe is mounted so as to be tilted upward by a predetermined angle from a center line of the chamber outlet for supporting the drain pump assembly, and wherein the drain pump assembly is mounted so as to be tilted upward at a predetermined angle from an inside bottom surface of the cabinet, and the drain pump assembly and the sump assembly are connected with an insulating material to each other.

2. The dish washer as claimed in claim 1, wherein the drain chamber is formed to have a depth that forms a minimum space L between an outside bottom surface of the drain chamber and the inside bottom surface of the cabinet.

3. The dish washer as claimed in claim 2, wherein the minimum space L is a space large enough to prevent the drain pump assembly from interfering with the inside bottom surface of the cabinet when the drain pump assembly is coupled to the chamber outlet.

4. The dish washer as claimed in claim 2, further comprising a check valve member placed in the chamber outlet for preventing residual water from flowing in a reverse direction from the drain pump assembly.

* * * * *